US011427287B1

(12) United States Patent
Dollar

(10) Patent No.: US 11,427,287 B1
(45) Date of Patent: Aug. 30, 2022

(54) WEIGHT DISTRIBUTION SYSTEM AND METHOD OF MODIFYING A WAKE

(71) Applicant: Elliott B. Dollar, Beamount, TX (US)

(72) Inventor: Elliott B. Dollar, Beamount, TX (US)

( * ) Notice: Subject to any disclaimer, the term of this patent is extended or adjusted under 35 U.S.C. 154(b) by 0 days.

(21) Appl. No.: 16/902,895

(22) Filed: Jun. 16, 2020

(51) Int. Cl.

| | |
|---|---|
| ***B63B 34/70*** | (2020.01) |
| ***B63B 43/08*** | (2006.01) |
| ***B63B 39/02*** | (2006.01) |
| ***B63B 39/03*** | (2006.01) |

(52) U.S. Cl.
CPC ..... *B63B 34/70* (2020.02); *B63B 39/02* (2013.01); *B63B 39/03* (2013.01); *B63B 43/08* (2013.01)

(58) Field of Classification Search
CPC ..... B63B 34/70; B63B 43/00; B63B 43/08; B63B 39/00; B63B 39/02; B63B 39/03; B63B 35/00; B63B 35/85
USPC ..... 114/124, 121
See application file for complete search history.

(56) References Cited

U.S. PATENT DOCUMENTS

| | | | | |
|---|---|---|---|---|
| 5,433,162 A * | 7/1995 | Shigematsu | ..... | B63B 39/02 114/124 |
| 6,019,056 A * | 2/2000 | Maeda | ..... | B63B 39/02 114/124 |
| 9,038,554 B2 * | 5/2015 | de Troz | ..... | B63B 39/02 114/124 |
| 9,150,291 B2 * | 10/2015 | Dollar | ..... | B63B 43/08 |

* cited by examiner

*Primary Examiner* — Lars A Olson
(74) *Attorney, Agent, or Firm* — Leavitt Eldredge Law Firm

(57) ABSTRACT

A weight distribution system configured to be integral with a boat or with its structure or hull. The system includes a weight distribution device that translates a cart of weight from one position within a space to another position along a rail. The system is activated by a control that is remote to the system. The system allows for a person to quickly and conveniently alter the weight within the boat to alter, improve or otherwise shape the wake created by the boat.

2 Claims, 4 Drawing Sheets

WEIGHT DISTRIBUTION SYSTEM AND METHOD OF MODIFYING A WAKE

BACKGROUND

1. Field of the Invention

The present invention relates generally to watercraft systems, and more specifically, to a weight distribution system for systematically, conveniently and precisely maintaining a desired weight distribution level in a vessel. Although potentially beneficial in a multitude of non-marine industries, the benefits described are of primary relevance to the water sport discipline of wakeboarding. In wakeboarding, it is important to maintain proper weight distribution within the watercraft pulling the wakeboarder. At higher speeds, generally above 15 mph, a wakeboard specific watercraft is designed to produce large, evenly shaped wakes that are used by a wakeboard rider to launch into the air, where they perform various aerial maneuvers. Proper weight distribution from left to right or portside to starboard side—also considered roll, as well as front to back or bow to stern—also called pitch, create the ideal conditions and proper wake shape for wakeboarding and other wake related sports.

2. Description of Related Art

Watercraft systems are well known in the art and are effective means to allow for travel across water. Currently, only non-efficient and inconvenient ways exist of distributing weight within water-sports specific watercraft. One method is to ask passengers to shift around to different seating positions within the watercraft. This activity helps achieve the desired vessel position, regarding roll and pitch, but it is time-consuming, inconvenient, frustrating and often inaccurate.

Another method of addressing the wake creation of a watercraft is to employ a ballast system that pumps water in and out of stationary large containers, designed to create more water displacement, producing larger wakes when a watercraft is running at higher speeds. An example system is revealed in U.S. Pat. No. 6,427,616. These ballast capabilities provide another method of weight distribute within a watercraft, where the operator adjusts the water level in a specific stationary ballast container to help compensate for weight distribution needs. However, this method usually involves pumping water from a respective ballast tank, resulting in less vessel displacement, which has a minimizing effect on the wake size that counteracts the design purpose of a ballast system. However, a drawback to this pumping method is the time required to displace the water and the inaccuracy of its placement. Considering the density of water, another issue is the space required within a vessel to employ a water container for weight distribution purposes. Some watercraft models might benefit from such a design, as in the case with large ships where space is not a concern.

Another method employs manually placing weighted objects within the watercraft to achieve the desired vessel balance. This method is inconvenient to the operator and passengers as weight distribution needs fluctuate between a variety of scenarios within a short period of time. These extra weights within the watercraft are inconvenient, dangerous, and manually moving them according to ever-changing scenarios is impractical and inconvenient.

Accordingly, although great strides have been made in the area of watercraft systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
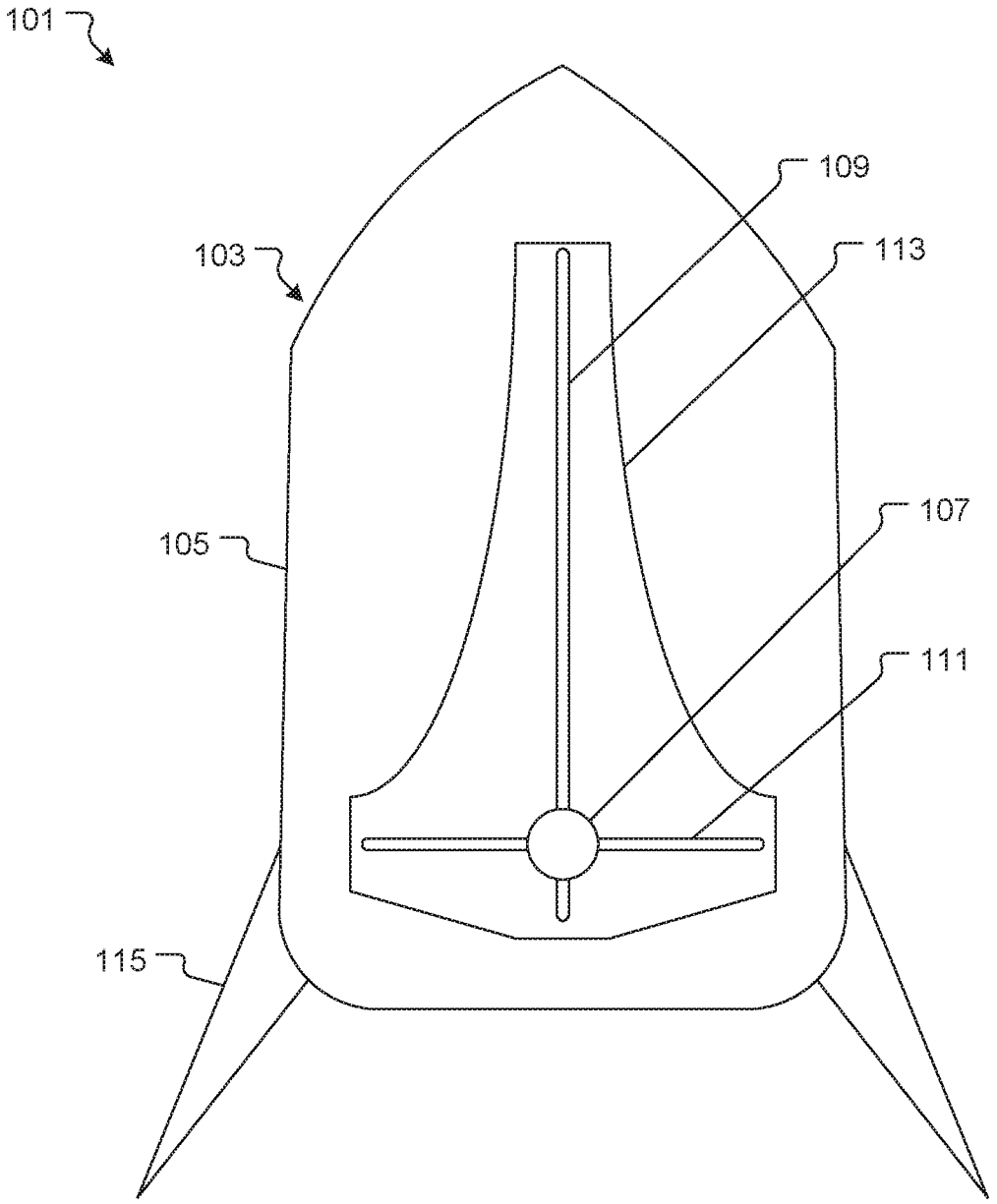
FIG. 1 is a top view of a weight distribution system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional watercraft systems. Specifically, the invention of the present application creates an automatic method of moving both fixed and variably weighted ballast object(s) within the watercraft to shape and control the wake responsively and conveniently. In addition, the invention is integrated within the watercraft. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a perspective view of a weight distribution system in accordance with a preferred embodiment of the present application. It will be appreciated that system 101 overcomes one or more of the above-listed problems commonly associated with conventional watercraft systems.

In the contemplated embodiment, system 101 includes a watercraft 103 in which a weight distribution device 107 is installed in a space 113 within the hull 105 thereof. The weight distribution device 107 is configured to move along a first axis 109 and a second axis 111 within the space 113 to alter the wake 115 created by the watercraft 103.

Figure 2:
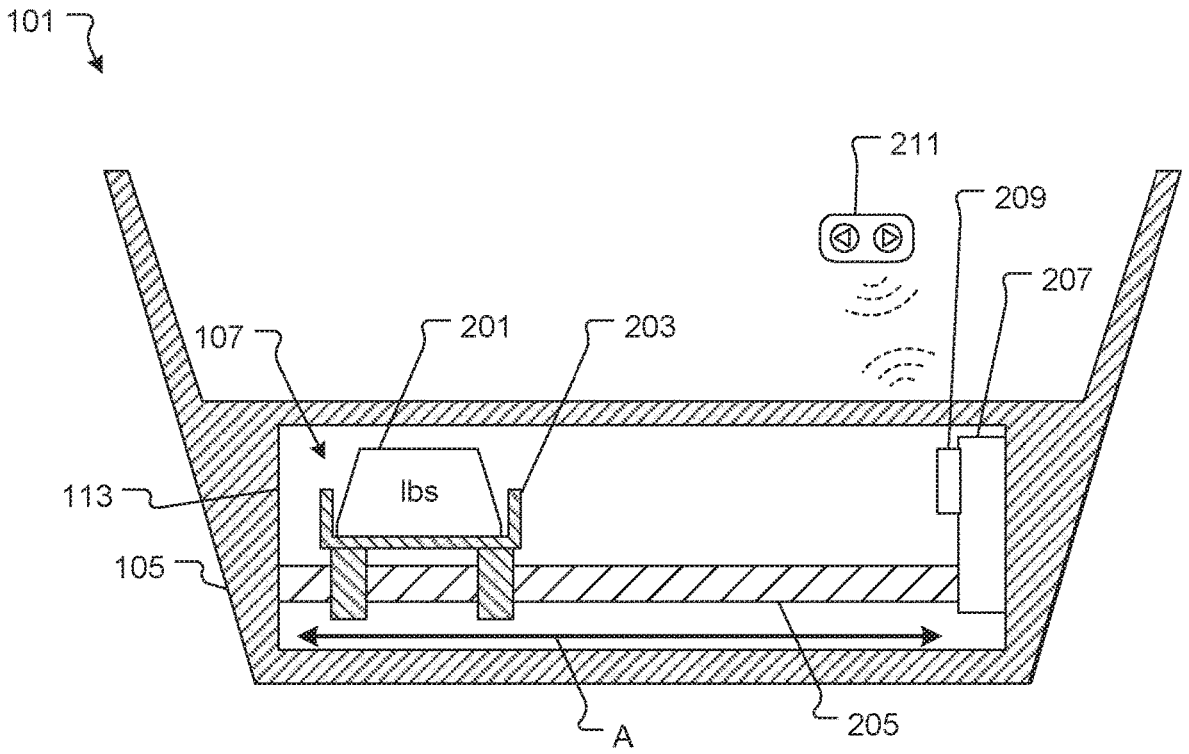
FIG. 2 is a cross-sectional back view of the weight distribution system of FIG. 1.

Referring now to FIG. 2 the weight distribution system 101 is further depicted. In the present embodiment a threaded rail 205 is secured within the space 113. A cart 203 or carrier is rotationally attached to the threaded rail 205 and is configured to carry weight 201. A motor 207 is also housed in space 113 and is configured to rotate the threaded rail 205 and cause the cart 203 to translate from one position to another as depicted by motion A. It is contemplated that a transceiver 209 is in electronic communication with a control 211 by which a person activates the motor 207 thereby.

It is contemplated that the space 113 and the cart 203 are accessible via an opening, port or the like. It is further contemplated that the weight 201 is able to be modified by the user. It is further contemplated that weight 201 used could be a fixed or of a changeable amount. It will be understood that the cart 203 could be of any configuration so as to carry the weight 201 along the threaded rail 205.

In use, as the watercraft 103 moves about, a person activates the motor 207 via the control 211 so that the position of the weight 201 is altered and subsequently the center of gravity of the watercraft 103. This movement of the weight 201 alters the shape or makeup of the wake 115 formed by the movement of the watercraft 105.

Figure 3:
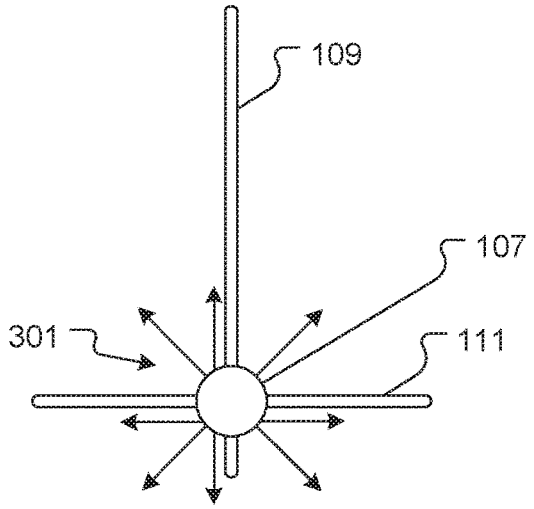
FIG. 3 is a top view of the movement of the system of FIGS. 1 and 2.

Referring now to FIG. 3 the contemplated movement of the weight 201 in cart 203 is depicted. It is contemplated that the first axis 109 and the second axis 111 are attached so that each may traverse the other. This allows for the cart 203 of the weight distribution device 107 to move the weight 201 about in any of the directions 301.

It should be appreciated that one of the unique features believed characteristic of the present application is that the weight distribution device 107 enables the translation of the weight 201 bearing cart 203 along the threaded rail 205 to alter wake 115 of the watercraft 103.

Figure 4A:
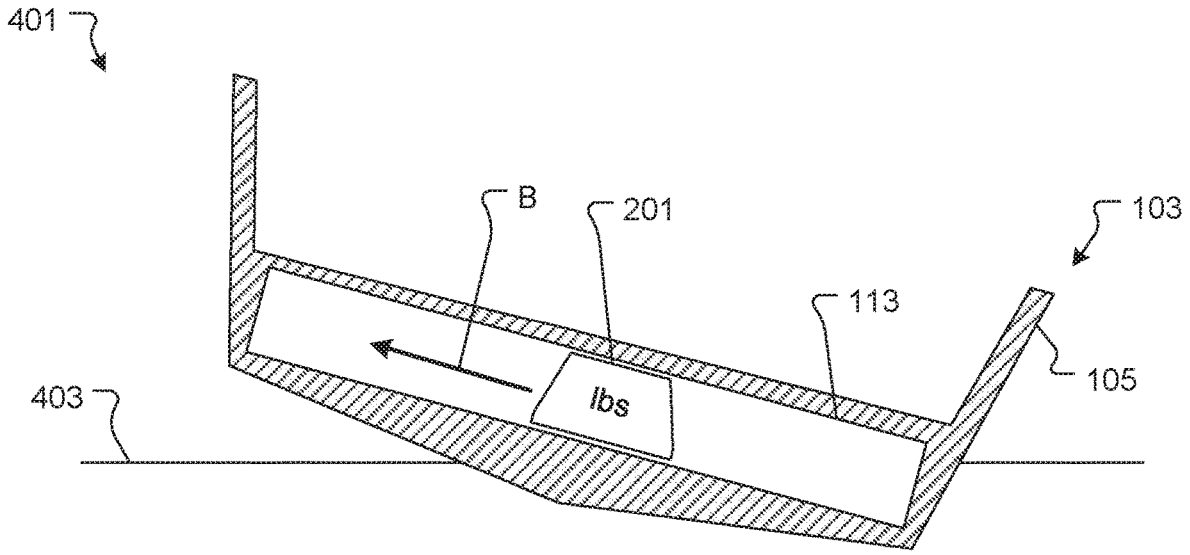
FIGS. 4A and 4B are cross-sectional back view of the system in use.
Figure 4B:
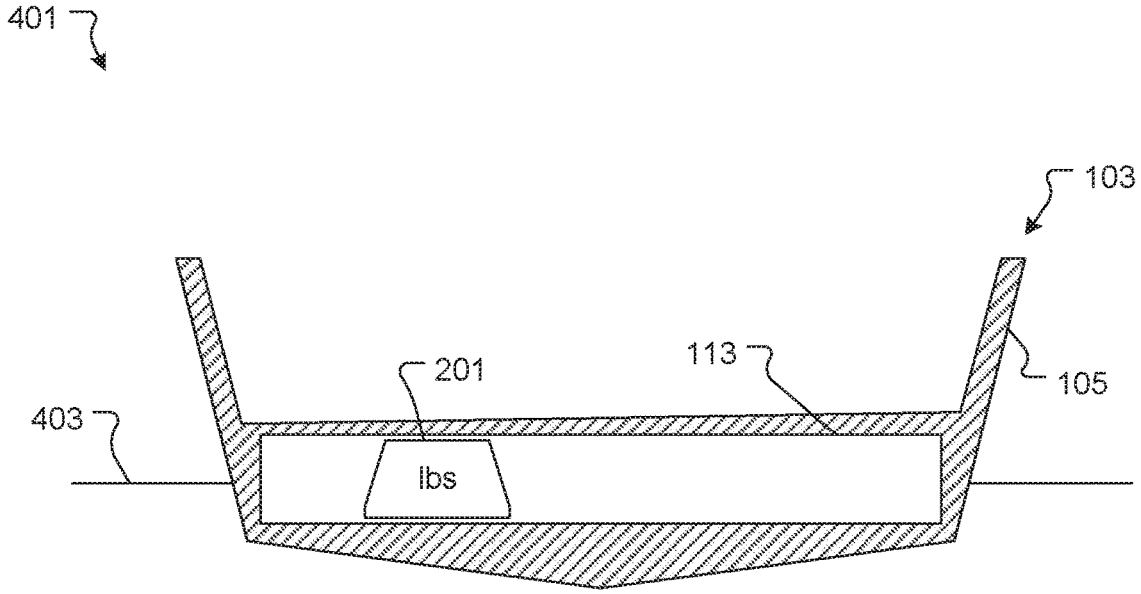

It will be understood and appreciated that relocation of the weight 201, as depicted by FIGS. 4A and 4B, alters the center of gravity of the watercraft 103 as well as the relation of the watercraft 103 to the surface of the water upon which it moves. For example, when the watercraft 103 turns to the right as depicted by FIG. 4A the boat will rise on the left and alter the wake. The weight 201 is moved within the space 113 of the hull 105 as depicted by motion B and the watercraft 103 settles back in the water 403 as depicted by FIG. 4B.

Figure 5:
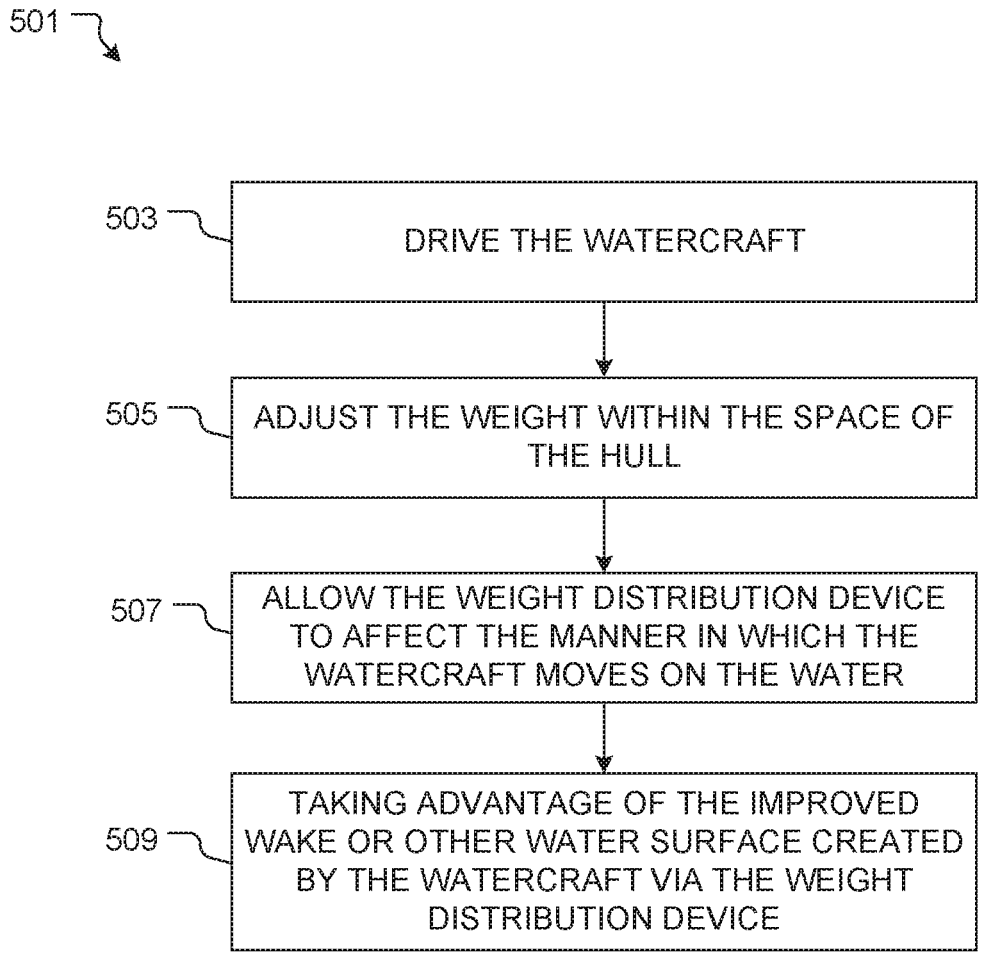
FIG. 5 is a flowchart of a method of altering the distribution of weight in a watercraft.

Referring now to FIG. 5 the method of altering the wake of a watercraft is depicted. Method 501 includes; driving a watercraft 503, adjusting the weight within the space of the hull 505, allowing the weight distribution device to affect the manner in which the watercraft moves on the water 511 and taking advantage of the improved wake or other water surface created by the watercraft via the weight distribution device 513.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A weight distribution system comprising:

a watercraft with a hull having a space disposed therein, the space having a length and a width;

at least one weight distribution device having:

a first axis extending in a direction parallel to the width of the space;

a second axis extending in a section direction perpendicular to the first axis, the second axis is attached to the first axis and positioned perpendicular to the first axis;

a cart disposed within the space and configured directly engage with the first axis and the second axis, the cart is configured to travels on both the first axis and the second axis;

at least one weight secured to the cart; and at least one motor configured to rotate the second axis;

a transceiver conductively coupled to the motor;

a control in wireless communication with the transceiver, the control is configured to manually activate the motor via the transceiver;

wherein when the weight is moved within the space via the cart via the remote to create a desired wake configuration.

2. The system of claim 1 wherein the amount of weight carried by the cart is increased.

* * * * *